US007712923B2

(12) United States Patent
Huang et al.

(10) Patent No.: US 7,712,923 B2
(45) Date of Patent: May 11, 2010

(54) LED LAMP ASSEMBLY

(75) Inventors: Xing-Gui Huang, Shenzhen (CN); Li He, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 31 days.

(21) Appl. No.: 12/246,480

(22) Filed: Oct. 6, 2008

(65) Prior Publication Data

US 2010/0085756 A1 Apr. 8, 2010

(51) Int. Cl.
*F21V 33/00* (2006.01)

(52) U.S. Cl. ..... 362/267; 362/800; 362/249.02

(58) Field of Classification Search ..... 362/267, 362/800, 249.02, 545, 555
See application file for complete search history.

(56) References Cited

U.S. PATENT DOCUMENTS 5,765,940 A * 6/1998 Levy et al. ..... 362/240
6,435,691 B1 * 8/2002 Macey et al. ..... 362/101
6,957,905 B1 * 10/2005 Pritchard et al. ..... 362/554

* cited by examiner

*Primary Examiner*—Laura Tso
(74) *Attorney, Agent, or Firm*—Frank R. Niranjan

(57) ABSTRACT

An LED lamp assembly includes an LED lamp and a driving circuit module mounted on the LED lamp. The LED lamp includes an airproof chamber. A plurality of LED modules is received in the airproof chamber. A gasbag is located at the driving circuit module and communicates with the airproof chamber of the LED lamp. The gasbag receives air from the airproof chamber when the LED modules are activated to lighten and heat the airproof chamber.

10 Claims, 6 Drawing Sheets

LED LAMP ASSEMBLY

BACKGROUND OF THE INVENTION

1. Field of the Invention

The present invention relates to an LED lamp assembly, and more particularly to an LED lamp assembly having a gasbag to adjust pressure in an airproof chamber of the LED lamp assembly via expanding and shrinking of the gasbag.

2. Description of Related Art

A conventional LED lamp comprises a heat sink, a plurality of LED modules having LEDs attached to an outer surface of the heat sink and an envelope engaging with the outer surface of the heat sink. The envelope and the heat sink forms a chamber to receive the LED modules therein. When the LED lamp works, heat is generated by the LED modules; air in chamber of the LED lamp is heated to expand. Therefore a pressure in the chamber of the LED lamp is higher than that outside the chamber. When the LED lamp is cooled, an airflow of the ambient air with impurity is drawn into the chamber of the LED lamp. Therefore, the LED modules and other components inside the LED lamp are contaminated by the impurity.

What is needed, therefore, is an LED lamp assembly having a gasbag to adjust pressure in an airproof chamber of the LED lamp assembly.

SUMMARY OF THE INVENTION

An LED lamp assembly includes an LED lamp and a driving circuit module mounted on the LED lamp. The LED lamp includes an airproof chamber. A plurality of LED modules is received in the airproof chamber. A gasbag is located at the driving circuit module and communicates with the airproof chamber of the LED lamp. The gasbag can adjust a pressure of the airproof chamber.

Other advantages and novel features will become more apparent from the following detailed description of preferred embodiments when taken in conjunction with the accompanying drawings, in which:

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
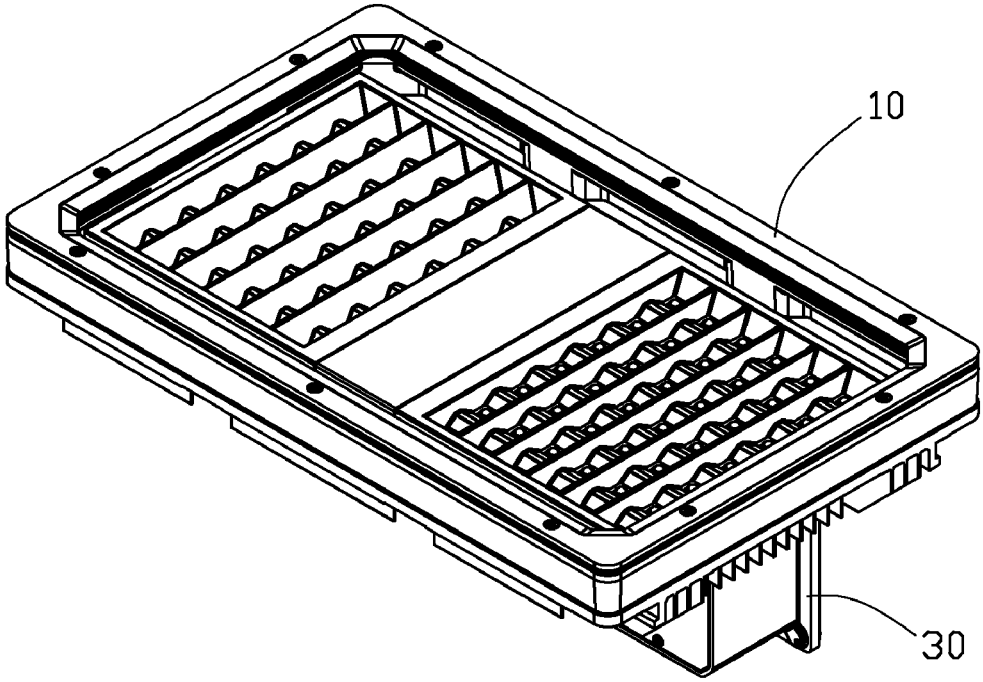
FIG. 1 is an assembled, isometric view of an LED lamp assembly in accordance with a preferred embodiment of the present invention.

Referring to FIG. 1, an LED lamp assembly comprises an LED lamp 10 and a driving circuit module 30 mounted on a side of the LED lamp 10.

Figure 2:
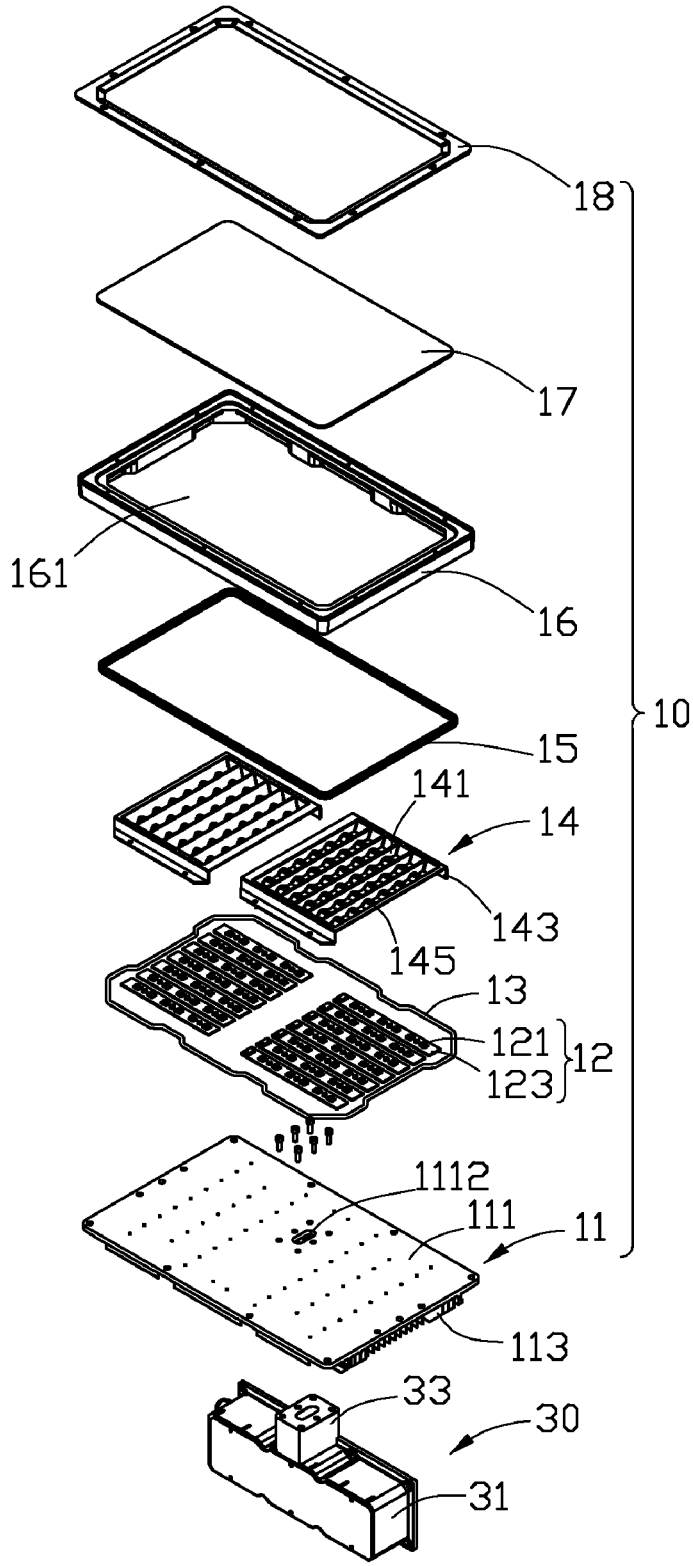
FIG. 2 is an exploded view of FIG. 1.
Figure 3:
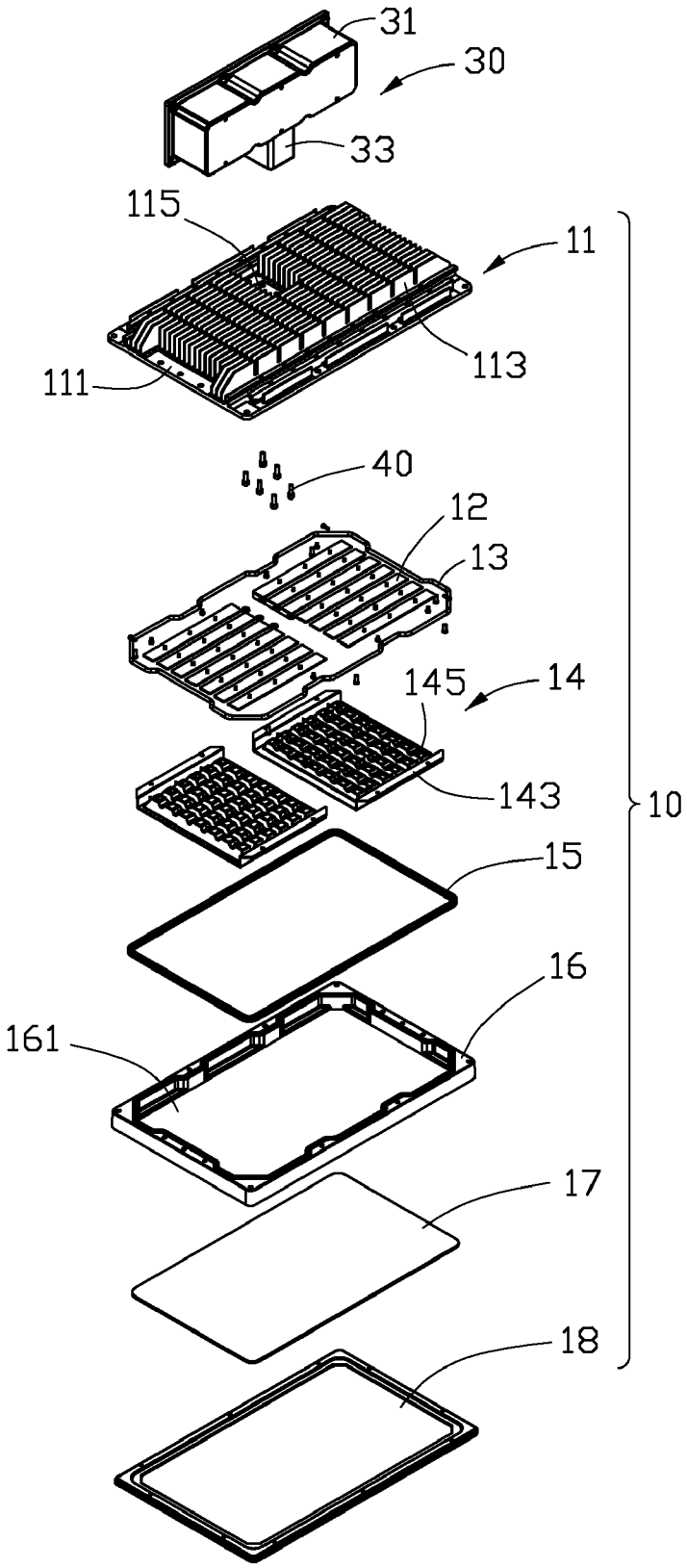
FIG. 3 is an inverted view of FIG. 2.

Referring to FIGS. 2-3, the LED lamp 10 comprises a heat sink 11, a plurality of LED modules 12 mounted on the heat sink 11, two reflectors 14 mounted on the heat sink 11 and over the LED modules 12, a frame 16 mounted on the heat sink 11, a transparent cover 17 inserted in the frame 16, and a pressing member 18 pressing the cover 17. The heat sink 11, the frame 16, the cover 17, and the pressing member 18 form an airproof chamber.

The heat sink 11 comprises an elongated base 111 and a plurality of fins 113 extending downwardly from a bottom surface of the base 111. The base 111 defines a through hole 1112 in a center portion thereof. A receiving trap 115 is defined in the fins 113 and communicates with the through hole 1112 of the base 111. The LED modules 12 thermally contact a top surface of the base 111.

Each LED module 12 comprises an elongated printed circuit board 123 and a plurality of spaced LEDs 121 evenly mounted on a side of the printed circuit board 123. The LEDs 121 of each LED module 12 are arranged along a longitudinal direction of the printed circuit board 123. Each LED module 12 is mounted in a thermally conductive relationship with the top surface of the heat sink 11 and electronically connects with the driving circuit module 30.

Each reflector 14 comprises a plurality of spaced, vertical connecting plates 141, a U-shaped engaging portion 143 around the connecting plates 141, a plurality of reflecting plates 145 sandwiched between the connecting plates 141 to reflect light emitted from the LED modules 12. The engaging portion 143 is mounted on the base 111 of the heat sink 11. Each of the reflecting plates 141 covers a corresponding LED module 12.

The frame 16 has a rectangular configuration and defines a rectangular opening 161 in a center portion thereof. The frame 16 encloses the LED modules 12 therein. The cover 17 is rectangular and mounted on the frame 16. The pressing member 18 is annular and engages with the frame 16 to sandwich the cover 17 therebetween. A ring-shaped gasket 13 is sandwiched between the base 111 of the heat sink 11 and the frame 16. Another ring-shaped gasket 15 is sandwiched between the frame 16 and the pressing member 18. These gaskets 13, 15 are used to enhance hermeticity of the LED lamp 10.

Figure 4:
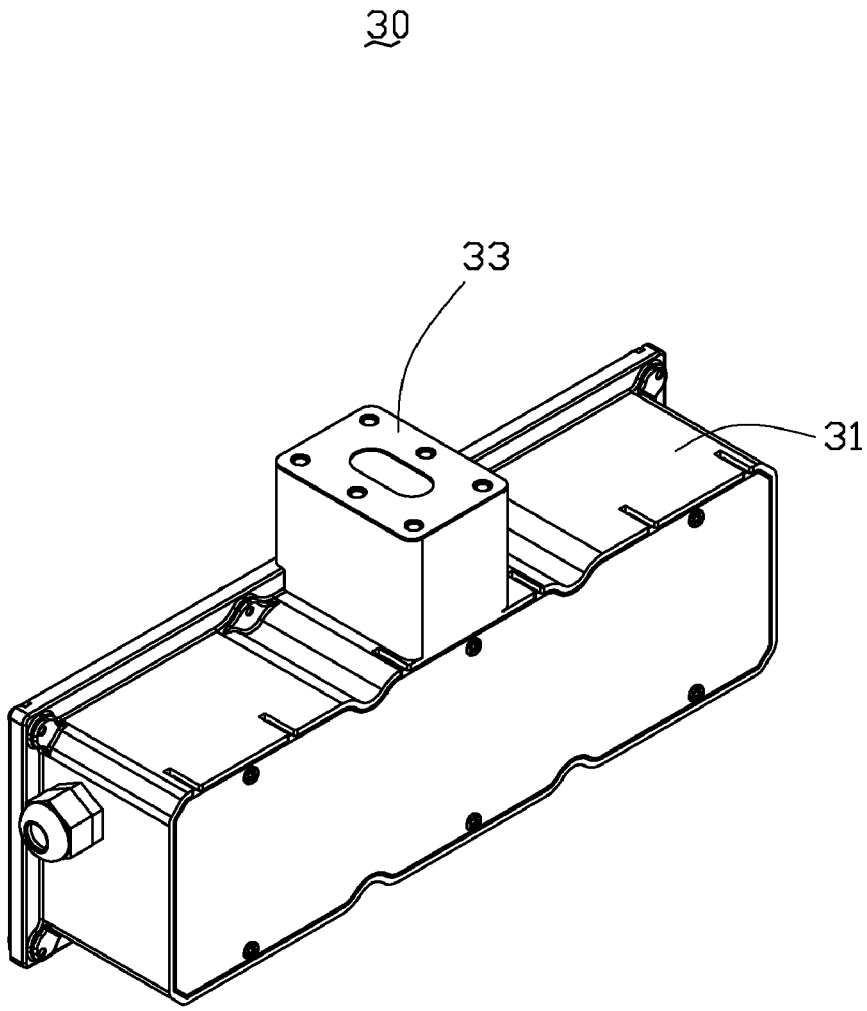
FIG. 4 is an assembled, isometric view of a driving circuit module of FIG. 1.
Figure 5:
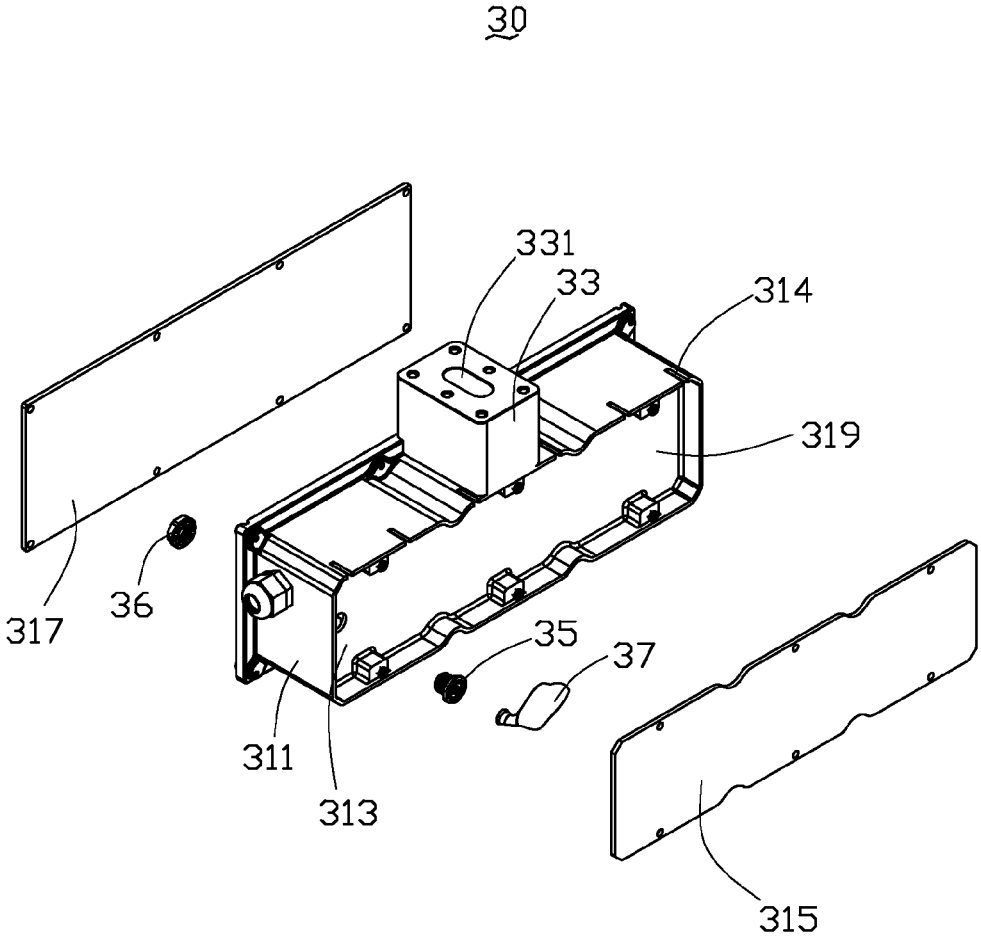
FIG. 5 is an exploded view of FIG. 4.
Figure 6:
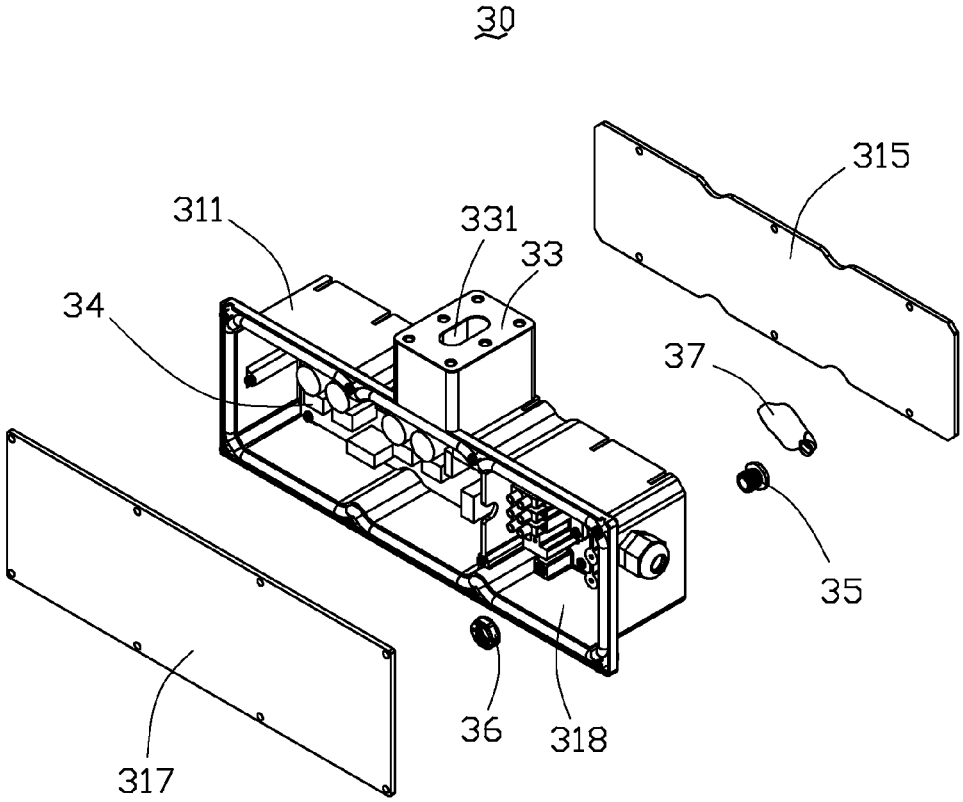
FIG. 6 is an exploded view of FIG. 4, but shown from another aspect.

Referring to FIGS. 4-6, the driving circuit module 30 comprises a driving portion 31 and a connecting portion 33 extending towards the heat sink 11.

The driving portion 31 has a cuboid configuration. The driving portion 31 comprises an annular main body 311 and a rectangular engaging plate 313 fittingly received in the main body 311. The main body 311 is divided into two portions by the engaging plate 313. An elongated first baffling plate 315 and a second baffling plate 317 close opposite ends of the main body 311. The second baffling plate 317, the main body 311 and the engaging plate 313 defines a first chamber 318. The first baffling plate 315, the main body 311 and the engaging plate 313 defines a second chamber 319. The first chamber 318 is airproof and a driving module 34 is received therein to electronically connect with the LED modules 12. A plurality of slots 314 is defined in a side of the main body 311 corresponding to the second chamber 319 to make the second chamber 319 communicate with the ambient. A tube 35 extends through the engaging plate 313. The tube 35 is fixed to the engaging plate 313 by a nut 36. A gasbag 37 is located at the second chamber 319 and connects with the tube 35.

The connecting portion 33 is located at a center portion of a side of the driving portion 31. The connecting portion 33 is cuboid. A through hole 331 is defined in a center portion of the connecting portion 33 to make the connecting portion 33 communicate with the first chamber 318 of the driving portion 31. The connecting portion 33 is received in the receiving trap 115 of the heat sink 11. The through hole 331 of the connecting portion 33 corresponds to the through hole 1112 of the base 111 of the heat sink 11. A plurality of screws 40 extends through the base 111 of the heat sink 11 and engages with the connecting portion 33 to assemble the driving circuit module 30 on the heat sink 11.

When the LED modules 12 are activated, heat generated by the LEDs 121 is absorbed by the heat sink 11. The pressure of air in the airproof chamber defined by the heat sink 11, the frame 16, the cover 17, and the pressing member 18 is raised; thus, the air of the airproof chamber enters into the gasbag 37 via the tube 35 to adjust the pressure in the airproof chamber. When the LED lamp 10 is cooled, the pressure of the airproof chamber is reduced, and the air of the gasbag 37 is drawn into the airproof chamber of the LED lamp 10 through the tube 35.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp assembly comprising:

an LED lamp comprising an airproof chamber, a plurality of LED modules received in the airproof chamber; and a driving circuit module mounted on the LED lamp, a gasbag located at the driving circuit module and communicating with the airproof chamber of the LED lamp, the gasbag receiving air from the airproof chamber when the LED modules are activated to lighten.

2. The LED lamp assembly as claimed in claim 1, wherein the driving circuit module comprises a hermetical first chamber communicating with the airproof chamber of the LED lamp and a second chamber communicating with ambient air, the gasbag being located at the second chamber of the driving circuit module and communicating with the first chamber.

3. The LED lamp assembly as claimed in claim 2, wherein the driving portion comprises an annular main body and an engaging plate fittingly received in the main body to divide the main body into two opposite portions, one baffling plate being closed to one portion of the main body to define the first chamber with the engaging plate, another baffling plate being closed to another portion of the main body to define the second chamber with the engaging plate.

4. The LED lamp assembly as claimed in claim 3, wherein a plurality of slots is defined in the main body corresponding to the second chamber to make the second chamber communicate with the ambient air.

5. The LED lamp assembly as claimed in claim 3, wherein a tube extends through the engaging plate and connects the first chamber with the gasbag.

6. The LED lamp assembly as claimed in claim 3, wherein a driving module is mounted in the first chamber of the driving portion of the driving circuit module to electronically connect with the LED modules.

7. The LED lamp assembly as claimed in claim 3, wherein the driving circuit module further comprises a connecting portion extending from the driving portion and hermetically connecting with the airproof chamber of the LED lamp.

8. The LED lamp assembly as claimed in claim 7, wherein the connecting portion defines a through hole therein to make the connecting portion communicate with the first chamber of the driving portion and the airproof chamber of the LED lamp via the connecting portion.

9. The LED lamp assembly as claimed in claim 1, wherein the LED lamp comprises a heat sink, a frame mounted on the heat sink, a cover mounted in frame, and a pressing member pressing the cover to the frame, the LED modules being mounted on the heat sink, and the heat sink, the frame, the cover, and the pressing member cooperatively defining the airproof chamber.

10. The LED lamp assembly as claimed in claim 9, wherein the driving circuit module is mounted on a side of the heat sink and communicates with the airproof chamber of the LED lamp.

* * * * *